United States Patent [19]

Chavez

[11] 4,281,834

[45] Aug. 4, 1981

[54] GOLF CHIPPING AND PITCHING DEVICE

[76] Inventor: Reuben Chavez, 1721 Huger, Cheyenne, Wyo. 82001

[21] Appl. No.: 63,386

[22] Filed: Aug. 3, 1979

[51] Int. Cl.[3] ..... A63B 69/36

[52] U.S. Cl. ..... 273/182 R; 273/407

[58] Field of Search ..... 273/181 R, 181 A, 182 R, 273/396, 397, 407, 398, 402

[56] References Cited

U.S. PATENT DOCUMENTS

| | | | |
|---|---|---|---|
| 1,771,466 | 7/1930 | Scanlon | 273/182 R X |
| 2,936,179 | 5/1960 | Thurston | 273/182 R |
| 3,264,001 | 8/1966 | Urban | 273/396 X |
| 3,350,097 | 10/1967 | Chevrette | 273/402 X |
| 3,526,405 | 9/1970 | Morris | 273/181 A |
| 3,719,362 | 3/1973 | Blanchard | 273/182 R |

*Primary Examiner*—George J. Marlo
*Attorney, Agent, or Firm*—John E. Reilly

[57] ABSTRACT

A device which is especially adapted for use as a golf practice unit or as a game takes the form of a solid ring or band mounted on an adjustable stand or base which is capable of supporting a target so that the target rests substantially in a horizontal plane. The target proper is comprised of a fabric or fabric-like material and is characterized in particular by having outer peripheral flaps extending from the outer surrounding edge of the target which are sized to be passed around opposite sides of the outer ring member, then adjustably secured together to establish the desired tautness in the target. One or more ball returns may be placed in the surface of the target so as to permit use and playing by a number of individuals at one time.

9 Claims, 5 Drawing Figures

GOLF CHIPPING AND PITCHING DEVICE

This invention relates to a novel and improved recreational device and more particularly relates to a golf chipping and pitching device intended as a practice aid to improve one's skill and accuracy in the game of golf.

FIELD OF THE INVENTION

The game of golf has attracted increasing numbers of people over the years. As a result, a number of different types of instructional aids and practice devices have been developed for golfers to improve their level of proficiency in playing the game. For instance, innumerable types of practice nets have been developed which will enable the golfer to practice his swing within a limited area or space. Short range targets have also been devised to the end of simulating actual conditions on a golf course so as to enable the golfer to improve his sense of feel and accuracy in and around the green. However, space limitations on the golf course and the increasing numbers of players have placed increased demands on playing facilities, for example, in providing chipping or practice greens since the amount of play rapidly wears down or kills the grass on and around the greens and makes the cost of maintaining such areas almost prohibitive unless play is restricted.

On golf driving ranges, the problem of wear can be alleviated somewhat by moving the practice tees periodically; or simply by employing artificial practice mats or tees so as to avoid the problem of grass maintenance. The same is not true however of chipping or pitching areas where the green cannot be moved and as a result of which the area surrounding the green rapidly becomes worn down so as to make it next to impossible to maintain at least during the peak months of play. In the past, of the various types of golf chipping or pitching targets devised, the approach generally taken has been to provde a target portion positioned on a stand and positioned at various different heights and angles to present a target for the golfer to shoot at. Generally the targets are of funnel-shaped configuration so as to direct the ball toward a center ball return. In this way, a golfer may hit a number of balls into the target and, through the ball return conduit, can be collected or recovered more easily than if the balls are merely permitted to accumulate on the target surface. Representative of the devices which have been provided in the past and specifically for use as golf chipping or pitching targets are those shown in U.S. Pat. No. 1,771,466 to Scanlon; Thurston U.S. Pat. No. 2,936,179; Urban U.S. Pat. No. 3,264,001; Chevrette et al U.S. Pat. No. 3,350,097 and Blanchard U.S. Pat. No. 3,719,362.

A particular difficulty associated with target devices of the type referred to for instance, those employing a funnel-shaped target, is that they do not accurately simulate conditions which a golfer will encounter in pitching or chipping to an actual green. Other than to afford some means of improving the accuracy in direction and distance of a shot, there is no way of ascertaining from the manner in which the ball strikes the target just how far it will roll or in other words whether it will have sufficient loft or backspin to stop within a relatively short distance. At the same time it is highly desirable that the target not only simulate actual playing conditions, but be readily transportable from site to site and be of sufficient strength and durability to stand up under repeated use. Moreover, it is desirable that the target be of a type which lends itself well either to individual use within a confined area, such as, a back yard or be usable by a number of players at once. As an illustration, a target which is properly designed to simulate actual playing conditions could be readily put to use on golf courses or other golf facilities so as to minimize or completely avoid necessity of maintaining chipping and pitching greens for the players.

SUMMARY OF THE INVENTION

It is therefore an object of the present invention to provide for a novel and improved ball target device which is specifically adaptable for use as a golf pitching and chipping target.

Another object of the present invention is to provide for a novel and improved golf pitching and chipping target which is capable of overcoming the aforementioned difficulties and problems associated with commercially available units and particularly to provide a target device which will more closely simulate actual playing conditions so as to afford a golfer with a better sense of accuracy and feel in practicing his shots.

It is a further object of the present invention to provide for a novel and improved golf target device which is of lightweight but sturdy construction, is readily transportable and is so designed as to provide a level target or playing surface onto which a ball may be struck and will accurately simulate a grass playing surface.

A still further object of the present invention is to provide a golf pitching and chipping device which incorporates a novel and improved method and means of securing a target in place so as to most accurately simulate playing conditions; and further wherein the target is readily replaceable and adjustable to the desired amount of tension.

In accordance with the present invention, a ball target apparatus has been devised which is specifically adaptable for use as a golf chipping and pitching device, the apparatus being characterized by being made up of an open frame having a generally circular, outer peripheral support rim which is adjustably mounted in a raised, horizontal position above the ground surface by circumferentially spaced adjustable leg members. A target in the form of a solid panel or sheet is preferably composed of canvas, duck or other fabric or fabric-like material having an outer peripheral edge dimensioned to fit within the support rim. However, to assure that the target may be inset or positioned in a plane beneath the upper edge of the support rim and fastened to the desired degree of tension or tautness, outer peripheral connecting means is provided to extend from the outer peripheral edge of the target panel around opposite upper and lower edges of the support rim, the connecting means being adjustably secured together outwardly of the support rim so as to stretch the panel under the desired degree of tension across the rim. Preferably the outer peripheral connecting means takes the form of a pair of generally circular flap or skirt members which are connected together along the outer peripheral edge of the panels, then diverge away from the panel so as to extend around the opposed upper and lower edges of the rim and terminate in outer free edges which can be folded over the external surface of the rim. Suitable apertures or openings are formed along the free edges of the flaps and are preferably staggered at spaced circumferential intervals to permit lacing together of the edges until the desired degree of tension is established in the panel. By virtue of the flap construction as described, the upper flap portion may form either an inclined annular skirt or surface sloping downwardly from the support rim for a limited distance into the relatively flat panel portion or may extend vertically along the inner surface of the rim. As a result, the target panel when positioned in a horizontal plane across the major area of the support rim will offer very much the same playing surface as the ground surface so that when a ball strikes the panel the golfer can ascertain by the speed and distance of roll across the panel whether he has properly struck the shot. The inclined flap or skirt around the outer surrounding edge of the panel will tend to retain the ball on the target and encourage its movement back toward the center of the target for recovery through one or more suitable ball returns positioned at an appropriate location or locations within the target panel.

The above and other objects, advantages and features of the present invention will become more readily appreciated and understood from the foregoing detailed description of a preferred embodiment when taken together with the accompanying drawings, in which:

DETAILED DESCRIPTION OF THE PREFERRED EMBODIMENT

Figure 2:
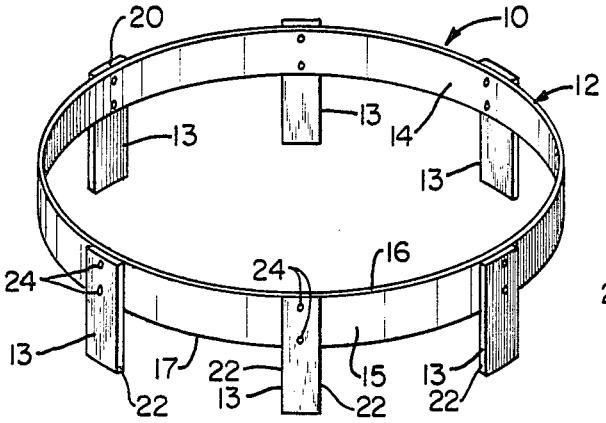
FIG. 2 is another isometric view of the preferred form of invention shown in FIG. 1 but with the target panel removed.

There is illustrated in FIGS. 1 to 5 a preferred embodiment of the present invention which is specifically adaptable for use as a golf pitching and chipping device. As shown in FIG. 2, the device is comprised of an open frame generally designated at 10, the frame 10 being made up of a generally circular ring or band 12 and a plurality of support legs 13 which are arranged at spaced circumferential intervals around the rim 12. Preferably, the rim 12 is composed of metal, such as, aluminum or sheet metal which is relatively lightweight but substantially rigid. It will be noted from the cross-sectional views of FIGS. 3 and 4 that the rim is of solid rectangular cross-section having an inner circular surface 14 and a correspondingly circular external surface 15 with upper edge 16 and lower edge 17, the upper and lower edges being slightly rounded. The band is designed to be of substantial width such that its vertical dimension is approximately one-third that of the length of a leg 13.

Each leg is preferably of rectangular configuration and is connected to the external surface of the rim such that upper edge 20 of a leg is flush with the upper edge 16 of the rim and lower edge 21 is spaced beneath the lower edge 17 of the rim. Opposite side edges 22 extend parallel to one another between the parallel upper and lower edges 20 and 21. The width of each leg is such as to provide a wide base 21 so as to establish a firm footing or ground support for the frame. In the preferred form, where for example the rim is on the order of 7′ in circumference, a series of eight legs are affixed to the rim so as to be spaced apart equally at less than 1′ intervals around the circumference of the rim. The legs are rigidly affixed to the rim by passing lag bolts 24 through upper and lower aligned apertures 25 and 26 in the legs 13 and around the rim 12 at equally spaced circumferential intervals. Preferably, the apertures 25 and 26 are vertically spaced apart so as to extend through the rim relatively near the upper and lower edges 16 and 17 and away from the center of the rim.

Figure 3:
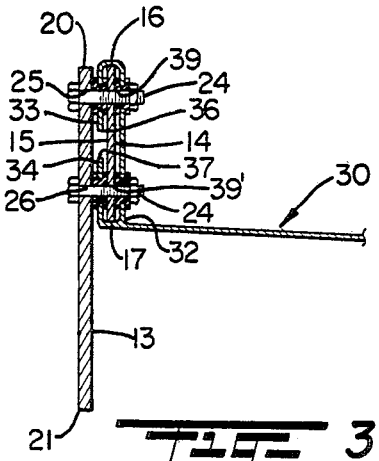
FIG. 3 is a cross-sectional view taken through one of the leg members shown in FIG. 1.
Figure 4:
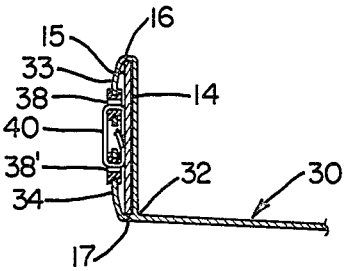
FIG. 4 is a cross-sectional view taken through a portion of the panel and rim between the leg members as shown in FIG. 1.
Figure 5:
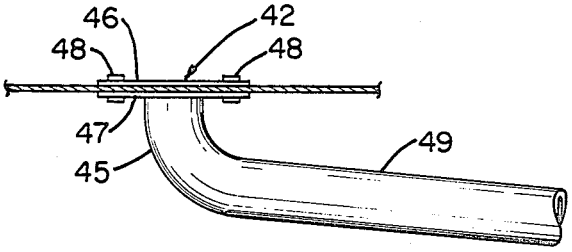
FIG. 5 is a cross-sectional view taken through the target panel of one of the ball return conduits.

An important feature of the present invention resides in the target panel as generally designated at 30 and its manner of interconnection to the rim 12. The target panel is preferably in the form of a sheet or solid panel of duck or canvas material having an outer peripheral edge 32 dimensioned to closely approximate the circumferential size of the rim so as to fit within the rim with the outer peripheral edge 32 contiguous to the inner surface 14 of the rim. The target panel 30 is affixed to the rim 12 by an outer peripheral connector assembly which is preferably in the form of a pair of generally circular or annular, upper and lower flap members 33 and 34 joined together along the common outer peripheral edge 32 of the panel. Preferably, the upper flap member 33 is of greater width than the lower flap member 34 so as to extend upwardly from the panel 30 around the inner wall surface of the rim and partially around the outer wall surface when the outer edge 32 of the panel is located adjacent to the lower edge 17 of the rim as shown in FIG. 4. The lower flap 34 is of a lesser width to extend from the lower edge 17 of the rim partially around its outer wall surface so that outer free ends 36 and 37 of the flaps 33 and 34 are spaced from one another. Lace-receiving openings 38 and 38′ are formed at spaced intervals along the free ends 36 and 37 to permit advancement of lacing or string 40 back and forth between the openings 38 and 38′, for example, in the manner shown in FIG. 1 and tying the ends of the lacing together. The degree of tautness in the panel 30 is readily adjusted by the degree of tightening or drawing together of the lacing. Each opening 38, 38′ is reinforced by a grommet, as shown in FIG. 4; and as shown in FIG. 3, additional openings 39 and 39′ may be formed in the upper flap 33 which are spaced to correspond with the spacing between apertures 25 and 26 in the rim. In this way, the lag bolts 24 can be inserted through the openings 25, 26 and the openings 38, 38′ at each of the leg members to unify the interconnection between the panel 30 and rim 12 in cooperation with the lacing 40.

Figure 1:
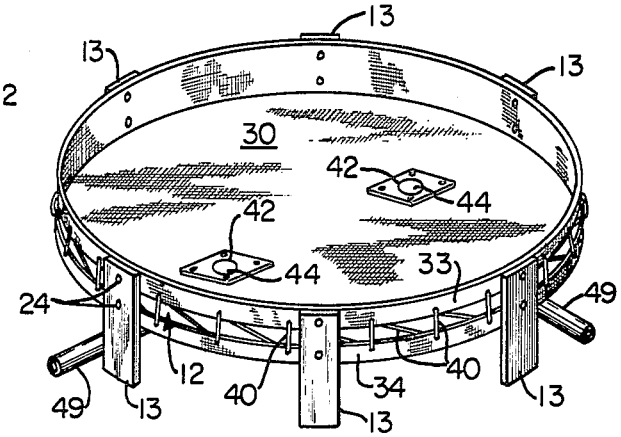
FIG. 1 is an isometric view of a preferred form of golf pitching and chipping device in accordance with the present invention illustrating the target panel in place.

As shown in FIG. 1, a pair of ball return conduits 42 are positioned in spaced relation to one another in the panel 30. Each ball return correspondingly includes an upper opening 44 in the panel through which is inserted an elbow-shaped fitting 45, the upper end of the conduit provided with reinforcing plates or flanges 46 and 47 on opposite sides of the panel in surrounding relation to the opening 44 and secured together by rivets or other suitable fasteners as represented at 48. The lower end of the elbow-shaped fitting 45 is joined to a straight duct 49 which is of a length to slope downwardly and somewhat horizontally away from the fitting to a point beyond the outer periphery of the rim 12. The entire conduit as defined by the fitting 45 and duct 49 is sized to permit a golf ball to pass freely by gravity therethrough for collection in a receptacle, not shown, which may be situated beneath the lower end of the duct 49. A pair of ball return conduits are shown in FIG. 2 which are spaced equidistant from the center of the panel so as to permit recovery of the balls through both conduits and to permit use of the target by more than one player. The added weight of the ball return conduits is such that a slight depression or dip is formed in the panel around the ball returns sufficient to encourage the balls to roll toward the entrances or openings therein. If desired, a single ball return conduit may be used and positioned more toward or at the center of the target. For example, a single ball return may be practical for use in smaller target areas.

The preferred form of target device is readily assembled by securing the panel or target 30 to the rim 12 in the manner described, then fastening the legs 13 to the rim 12 such that the bolts 24 extend through the flap members 33 and 34. The rim is in the form of an endless circular band by welding the free ends together or by fastening together with the use of bolts. Typically this may be done by overlapping the free ends and aligning pairs of apertures 25 and 26 adjacent to the free ends for insertion of the bolts 24. Once assembled the target is placed on a level surface, such as, on the ground so as to be in a level position spaced above the ground. The golfer may then practice chip or pitch shots at varying distances from the target. The level dispostion of the target coupled with the desired degree of tautness in the panel 30 will enable the ball to simulate the actual roll and bounce of a ball pitched onto a golf green. The raised position of the target will encourage the golfer to develop more loft in his shots and has been found to greatly improve a golfer's touch and shot-making proficiency around the green. Moreover, the arrangement of the target permits a number of players to practice at the same time which is not possible with an inclined target. The panel 30 when composed of a canvas material has been found to offer an excellent target surface; however, any suitable form of texturing or coating material may be applied to the upper surface of the canvas in order to further resist or retard bouncing or rolling of the balls. Of course, by fastening the upper flap member to extend over the inner surface of the rim 12 and the panel extending along the lower edge of the rim will prevent most balls from bouncing off of the target and encourage them to roll back toward one of the ball returns.

In order to modify the altitude or level disposition of the target, several of the legs 13 around one section of the target can be collapsed or swiveled to a horizontal position merely by removing one of the attaching bolts in each leg and pivoting each leg to a horizontal or tangential position with respect to the rim 12. The target may then have the rim 12 resting on the ground along the one section to afford a small degree of slope. When the target is not in use, it may be disassembled by removing the legs 13 and unlacing the flap members 33 and 34. The ball return conduits, if made in sections, may then be disassembled and stored separately from the panel 30.

Although the present invention has been described with particularity relative to the foregoing detailed description of the preferred embodiment, various modifications, changes, additions and applications other than those specifically mentioned therein will be readily apparent to those having normal skill in the art without departing from the spirt and scope of this invention.

I claim:

1. A ball target apparatus comprising:

an open frame member having an outer peripheral, generally circular support rim, and means to support said rim in an elevated, substantially horizontal position above the ground, and a target member defined by a panel composed of a fabric or fabric-like material dimensioned to terminate in an outer peripheral edge which will fit within said rim, and outer peripheral connecting means having a pair of generally circular flap members connected together along the outer peripheral edge of said panel and extending away from said panel around opposite upper and lower edges of said rim, said flap members terminating in free edges and provided with spaced openings along the length of said flap members adjacent to said free edges, and fastener means adapted to be passed through said openings in said flap members whereby to adjustably secure said flap members together along the external surface of said rim under a predetermined degree of tension.

2. A ball target apparatus according to claim 1, said support means for said rim defined by a plurality of leg members depending downwardly at spaced circumferential intervals from said rim whereby to support said rim in spaced relation above the ground.

3. A ball target apparatus according to claim 2, said leg members being connectable to said rim and movable between a horizontally extending position and a vertically extending position.

4. A ball target apparatus according to claim 1, said ball target including a ball return conduit having an entrance formed in said panel and a conduit section extending downwardly from the entrance whereby to permit gravity movement of balls therethrough.

5. A ball target apparatus according to claim 1, said rim being in the form of a relatively flat endless band having spaced upper and lower edges, and said panel being supported by said outer peripheral connecting means to extend radially inwardly from said lower edge of said rim.

6. A golf practice device comprising:

an open frame member having an outer peripheral, generally circular support rim provided with upper and lower edges, and means to support said rim in an elevated, substantially horizontal position above the ground, and a target member defined by a panel composed of a fabric or fabric-like material dimensioned to have an outer peripheral edge which will fit within said rim, and outer peripheral connecting means having a pair of generally circular flap members connected together along said outer peripheral edge of said panel and extending away from said panel around opposite upper and lower edges of said rim, said connecting means being adjustably secured together outwardly of said rim to stretch said panel across said rim under predetermined tension.

7. A golf practice device according to claim 6, said support means for said rim defined by a plurality of leg members depending downwardly at spaced circumferential intervals from said rim to support said rim in spaced relation above the ground, and means for interconnecting said flap members to said leg members and said rim.

8. A golf practice device according to claim 7, said leg members being connected to said rim and adapted to be movable between a horizontally extending position and a vertically extending position.

9. A golf practice device according to claim 6, said target including a pair of ball return conduits each having an entrance formed in said panel and a downwardly extending ball return conduit extending downwardly from the entrance whereby to permit gravity movement of balls therethrough, said conduit positioned on diametrically opposite sides of said panel.

* * * * *